US006643848B1

(12) United States Patent
May

(10) Patent No.: US 6,643,848 B1
(45) Date of Patent: Nov. 11, 2003

(54) CONVERTIBLE HAT WITH BILL OPTION

(76) Inventor: Bruce McNeal May, 83 Winchester Ct., Reading, PA (US) 19606

( * ) Notice: Subject to any disclaimer, the term of this patent is extended or adjusted under 35 U.S.C. 154(b) by 0 days.

(21) Appl. No.: 10/287,368

(22) Filed: Nov. 4, 2002

(51) Int. Cl.[7] ..... A42B 1/00
(52) U.S. Cl. ..... 2/209.12; 2/175.1
(58) Field of Search ..... 2/175.1, 209.11, 2/171, 195.1, 209.12

(56) References Cited

U.S. PATENT DOCUMENTS

| | | | | | |
|---|---|---|---|---|---|
| 2,743,455 | A | * | 5/1956 | Langness | 2/209.11 |
| 5,309,574 | A | * | 5/1994 | Balaban et al. | 2/202 |
| 5,579,540 | A | * | 12/1996 | Walker | 2/209.11 |
| 6,012,172 | A | * | 1/2000 | Steffy | 2/175.1 |
| 6,018,821 | A | * | 2/2000 | Adams | 2/209.11 |
| 6,026,514 | A | * | 2/2000 | Fricker | 2/209.11 |

* cited by examiner

*Primary Examiner*—John J. Calvert
*Assistant Examiner*—Katherine Moran

(57) ABSTRACT

A hat that extends beyond conventional hats and caps has two fundamental parts that provide substantially increased functionality. The hat comprises a crown to cover the head and a channel rim that makes the hat adaptable to varying conditions. This channel rim is of one-piece annular design, folded at the top and open at the bottom. The lower inner surface of the rim is attached to the lower circumference of the crown. This rim allows the hat to be altered in conformation to provide increased protection from adverse conditions. The rim also provides means to attach and, as desired, to make a bill available or invisible. This is accomplished by tucking the bill within the open portion of the channel rim when desired. The rim also offers the opportunity to store a plastic cover to be used to protect the hat in heavy rain. The bill is optional in some styles. When used, it protects from the sun and other overhead glare. It also provides protection to the eyes and face from rain, sleet or snow.

14 Claims, 4 Drawing Sheets

CONVERTIBLE HAT WITH BILL OPTION

CROSS-REFERENCE TO RELATED APPLICATIONS

Not applicable

BACKGROUND OF THE INVENTION

1. Field

This application relates to headwear, specifically to multipurpose hats for general wear with special adaptability for cool or cold weather wear.

2. Prior Art

The history of hats probably parallels the history of man. Headwear in one form or another has almost always been used. In addition to mere decorative uses, protection from sun, cold, wind, sand, or dust made wearing a head cover practical, even vital.

Over time, the role of hats has evolved in many ways. Oddly, the fundamental designs have not changed significantly over the years. Most prior hats were concerned with fashion and style, and follow parameters established many years ago.

Exceptions, of course, were made in hats designed for specific purposes. The helmet is an example, actually fulfilling a range of purposes. This is also true of the sun bonnet, bathing cap, night cap, and many more headwear articles.

Variations have been introduced with things like earmuffs, covers, and flaps. Also brims or partial brims, like bills or visors, were added in an effort to make the hat more practical. However, modifications in hats were primarily concerned with appearance and not function. Novelty in style, rather than utility, seems to have been a guiding force.

There seems to be some acceptance of the idea that hats and caps are different. The primary differentiation is the brim (projecting ridge or edge), which is characteristic of the hat. Caps have no brim but may have a bill or visor. While many different hats have been popular over time, the baseball cap reigns among caps. Often there is a general assumption that caps are for more casual wear.

I have found that many men fail to wear a hat even in the most inclement weather. The disadvantages of wearing a hat seem to outweigh its advantages of warmth, comfort, and protection for many men. My continued observations found this true for many women, also.

Existing hats do not have significant variations in function. There are some exceptions in current use, and these will be explored separately. I have found that four elements constitute most hat designs. These are the crown, rim, brim, and bill. Of these, three are relevant here; the crown, the rim, and the bill. To varying degrees, these basic elements are shown in the prior art as follows:

The Crown: This is the primary body of a hat and is the portion that actually covers the head. A review indicates that there are three basic forms of crowns.

(a) First is the one-piece crown, exemplified by the common fedora or the fringed hat to Krause in patent 1,428,891, Sep. 12, 1922. Most knitted hats also have a one-piece crown design.

(b) The second is constructed of curved triangles converging to a central point. Typically, most baseball caps are made this way. Examples can be seen in patents D446,909 to Colbert et al., Aug. 26, 2001, and in D385,389 to Bell, Oct. 28, 1997.

(c)The third form of the crown is essentially a two-piece design. This employs a flat, oval top attached to a side panel that provides the vertical lift. This type is not as common, but is shown in the collapsible hat patented by Williams, Jr., in patent D352,596, Nov. 22, 1994. The convertible head apparel patented by Adams, in U.S. Pat. No. 6,018,821, Feb. 1, 2000 uses a similar design for the crown but teaches a sidewall comprising a plurality of layers attached directly to the top, claim 1 of this patent refers specifically to "selected edges of the crown portion". The essence of this head apparel is to provide for appearance changes and for pockets to accommodate a brim and alternate visible surfaces. The hat/bag combination patented by Walker, in U.S. Pat. No. 5,579,540, Dec. 3, 1994 teaches a crown with an endwall, a sidewall and a collor brim. All variations of this hat/bag use this brim and none contain a channel or pocket within the brim. There are no provisions for allowing this brim to function as a rim.

The Rim: For clarification, the rim is an annular wall surrounding the crown. The rim is attached to the bottom of the crown. I have found that rims are uncommon and, when used, are prosaic. Ingram, in headgear U.S. Pat. No. 1,709,578, Apr. 16, 1929, shows a rim but this appears to be a locking device to hold the unit together. Patent D151,129 to Hodge, Sep. 28, 1948, uses a rim in a fashion motif. It seems to serve no utilitarian purpose. The hat designed by Finkelstein, in patent D68095, Sep. 1, 1925, and the cap proposed by Bonk, in patent 3,246,340, Apr. 16, 1966, each has a rim. Neither provides any alternative functions. The convertible head apparel patented by Adams, in patent 6,018,821, Feb. 1, 2000 does not teach a rim surrounding the crown in this manner.

The Bill: The bill or visor is certainly not new and exists in caps and some hats from the earliest patents. With few exceptions, such as Westmore, in patent D136,678, Nov. 16, 1943, most bills have been fairly rigid. Again, with few exceptions, such as Tuteur, in patent D169,523, May 5, 1953, bills have been a fixed part of the design. A study of the earlier designs indicates that these were not as large or horizontal as later models. Most popular baseball caps now use a fairly large, rigid, and reasonably horizontal bill. Observations suggest that, for most purposes, the present form of the bill is not necessarily the best. As now used, the bill tends to be obtrusive, with no advantages over some of the earlier designs.

Marketplace Prior Art: Some existing exceptions to the above discussion are shown in several designs marketed by Olney Hats of England. Their Fleece, Berber, and Reversible models have some flexibility in use. They do use a rim in their design, but not in the manner that will be described later. The bill is still prosaic. It is also evident that there is very limited use of varying fabrics and materials in their offerings. The same is true of the hat marketed by Lands End as their Faux Fur Pillbox, item 8135-7339.

There are also patterns for sewing some reasonably similar hats, including Model 2036 by McCall Patterns of 11 Penn Plaza, New York, NY. In several ways, these are like the hats offered by Olney. Though having a rim style, nothing offers significant versatility. It appears the rim may be turned down, but nothing more, and there is no provision for a bill.

OBJECTS AND ADVANTAGES

Accordingly, several objects and advantages of this invention are to provide a novel hat that:

(a) satisfies a basic need for something different in a hat that offers an interesting style, (b) has a style and appearance not dramatically different or unusual, (c) is very adaptable to changing weather and climatic conditions, (d) can be changed from a standard conformation to conformation for cold or adverse conditions in a simple and quick maneuver, (e) has great variability in colors and color combinations, (f) can be made from a large variety of materials, (g) when made with lightweight materials, can be adapted for warm weather uses, (h) can be made with water-resistant materials to provide added protection in rain, (i) makes the storage of the hats much easier with considerably less space required, (j) is "crushable," and thus can be placed in a pocket or in the sleeve of a coat that is checked or stored, (k) requires no new tooling in the manufacturing process, as it uses the standard "cut and stitch" manufacturing techniques, (l) has a degree of "stretch-ability" so that fewer sizes need be manufactured or stocked, (m) has the capacity to hold interest for men, women, and children, (n) though designed for those who do not like hats, has great appeal for hat lovers, (o) offers a very new winter option to those devoted to wearing baseball caps, (p) provides the sportsperson, hunter, or outdoor type expanded use and choices, (q) gives advanced options and choices as a spectator hat for outdoor sports, (r) when produced as a work hat, provides new head coverage choices for several seasons, (s) will provide the military services an advanced form of all-weather headwear, (t) is fun to wear and draws much interest and attention, (u) presents a new shape, consistent with the current fashion trend in hats, and (v) provides a flat surface rim that makes it practical for displaying pins, logos, or emblems.

SUMMARY

A new form of hat using a convertible concept contains an encircling rim attached to the crown, providing means to extend the rim downward during adverse weather. Thus it offers added warmth and protection. The rim may have an open, annular nature providing a pocket or channel that enables a bill to be added that can be extended out or hidden, as desired.

DRAWINGS—FIGURES

Figure 3A:
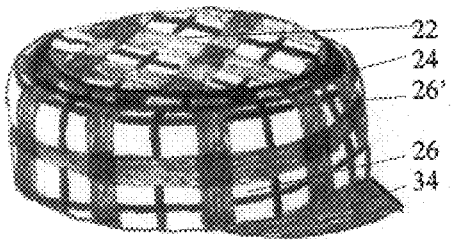
FIG. 3A shows a pictorial, perspective view of my hat similar to FIG. 2A.
Figure 3B:
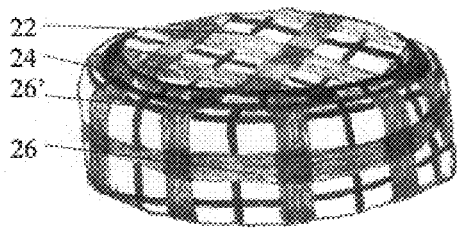
FIG. 3B shows a similar pictorial, perspective view of my hat containing a hidden bill.
Figure 3C:
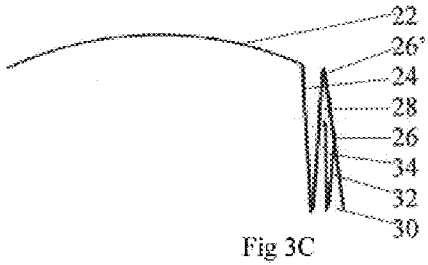
FIG. 3C shows a cross-sectional view of the hat of FIG. 3B with the bill folded and tucked within the open channel of the rim.
Figure 3D:
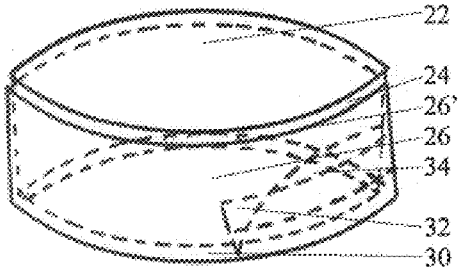

FIG. 3D provides a schematic line drawing from above of the hat of FIG. 3B with the bill hidden as shown in FIG. 3C.

Figure 3E:
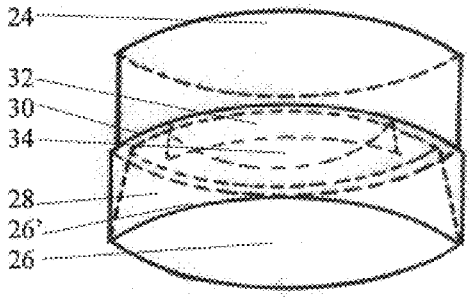

FIG. 3E shows a schematic line drawing from below of the hat resembling the configuration of 2E but with the rim turned down and the bill tucked within the rim as in FIG. 3D.

Figure 4A:
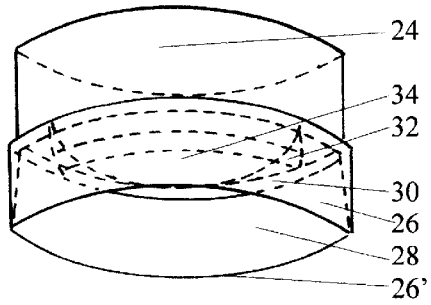

FIG. 4A shows a schematic line drawing of the hat with the crown reversed and extending upward and the bill 34 tucked within the open channel 30 of the rim.

Figure 4B:
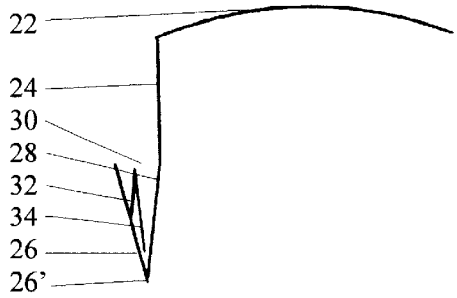

FIG. 4B is a cross-sectional view of the side panel 24, rim and bill of the hat of FIG. 4A.

Figure 5A:
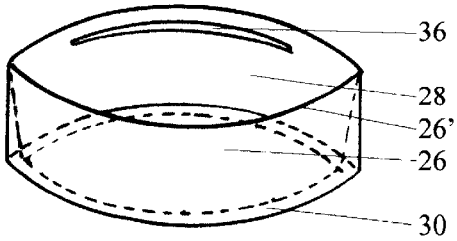

FIG. 5A is a schematic of the rim with a slot opening 36 in the inner layer 28 of the rim.

Figure 5B:
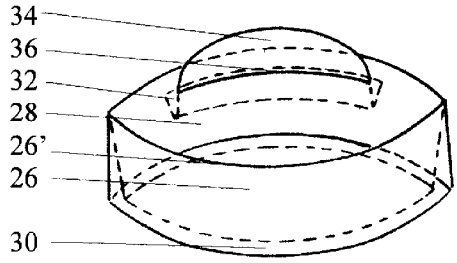

FIG. 5B is a perspective schematic view of the of the rim from above with the bill 34 passing through the slot opening 36 and projecting beyond the rim fold 26'.

Figure 5C:
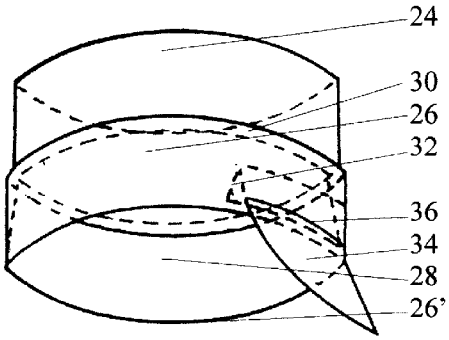

FIG. 5C shows a perspective schematic drawing of the hat from below with the bill 34 extending through the slot 36 in the rim inner layer 28.

Figure 5D:
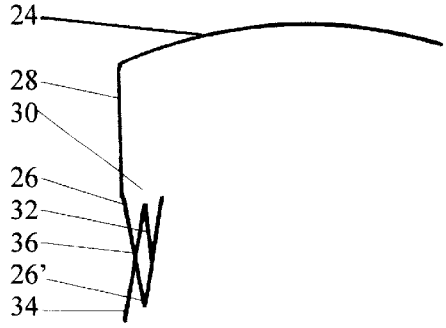

FIG. 5D is a cross-sectional representation of the conformation of the hat in FIG. 5C.

DRAWINGS—REFERENCE NUMBERS

20 curved triangular crown panel
22 crown top—flat oval
24 crown side panel
26 rim—outer layer
26' fold at rim top
28 rim—inner layer
30 open channel
32 flange for attaching bill
34 exposed portion of bill
36 slot opening in channel rim

DESCRIPTION—FIGS. 1A–1E—FIRST PREFERRED EMBODIMENT—DRESS AND MILLINERY

A first embodiment of my convertible hat is shown in FIGS. 1A to 1D. Specifically, the complete hat is shown in pictorial view in FIG. 1A and in schematic view is 1B. The details of its side panel are shown schematically in FIG. 1C.

Figure 1A:
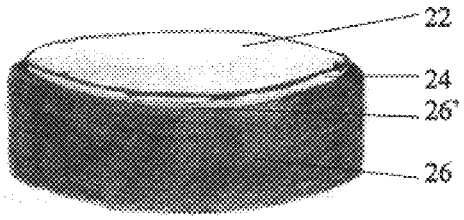
FIG. 1A shows a pictorial, perspective view of my hat without a bill or with the bill hidden.

As shown in FIG. 1A, the hat comprises a crown that is composed of two elements. There is a crown top 22 that is convex on its top and concave on its bottom. A vertical crown side panel 24 is attached to the crown top around its circumference. The crown side panel covers the side of the head. A rim surrounds the crown and consists of two vertical layers, folded at the top. The first layer is an inner layer 28 and the lower edge of this layer is attached to the bottom edge of the crown side panel. The second layer of the rim is an outer layer 26 which forms a fold 26' and extends down from the top of layer 28. Both layers 26 and 28 are generally parallel to the crown side panel 24.

Alternately, the rim inner layer 28 and outer layer 26 may be of different materials with the previous fold 26' actually becoming a seam where the layers are joined. In another variation, the crown side panel 24 and the rim inner layer 28 may be one piece with a fold at the bottom where the seam was in the other arrangement. Many construction alternatives exist.

The crown and the rest of the hat can be made from a large variety of materials. Among these are flannel, fleece, corduroy, denim, canvas, wool, faux fur, and cottons. Individual surfaces need not be made from the same fabrics as the other elements of the hat.

OPERATION—FIGS. 1A–1E—FIRST PREFERRED EMBODIMENT

Figure 1B:
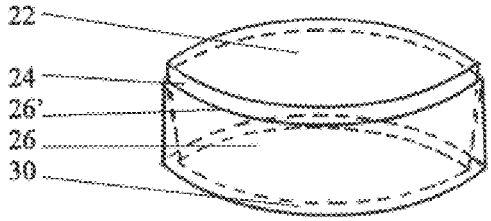
FIG. 1B shows a line drawing, perspective view of the hat of FIG. 1A.
Figure 1C:
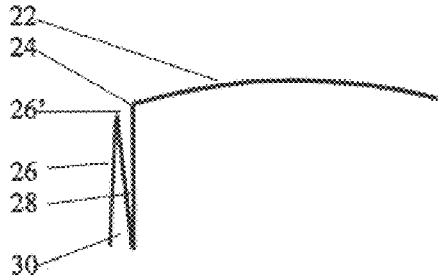
FIG. 1C shows a cross-section view of hat and rim of the hat of FIG. 1A.

In moderate weather, the hat is worn in the conformation of FIGS. 1A to 1C. The rim surrounds the crown with the layers of the crown parallel to the crown side panel. There is normal protection from sun and wind and even a degree of insulation from radiant heat. In this conformation the hat can be worn forward or backward on the head or at a jaunty angle, depending on the mood and desire of the wearer.

Figure 1D:
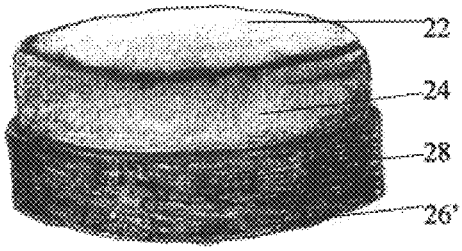
FIG. 1D shows a pictorial, perspective view of the hat of FIG. 1A with the rim turned down.
Figure 1E:
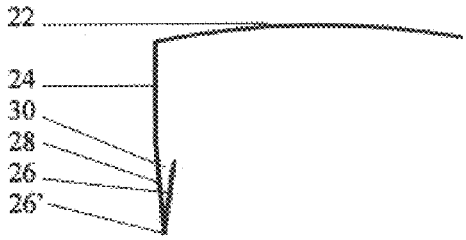
FIG. 1E shows a cross-sectional view of the hat in the conformation shown in FIG. 1D

In colder or more adverse weather the rim is turned outward and down as shown in FIGS. 1D and 1E. The outer layer of the rim now is inside, and the whole hat extends downward, covering more of the head and side of the face. This provides more warmth and protection. This can also offer a very different appearance if an alternate variation has been used. When the crown side panel 24 and rim inner layer 26 are made of one-piece construction, there is a solid, harmonious look in the adverse weather conformation.

Advantages

From the description of the hat in this embodiment, a number of advantages become evident:

(a) It can be modified on the run to meet changing conditions.

(b) The use of various materials allows adaptation to different social situation.

(c) The hat can be compacted without damage; it can be folded and put in a pocket without harm.

(d) One hat can serve a number of purposes.

(e) The lower profile is easier to wear in restricted space environments.

(f) In many fabrics and materials the hat can be fully unisex.

(g) The producer is given additional latitude in making the hat.

DESCRIPTION—FIGS. 2A–2E—SECOND PREFERRED EMBODIMENT—CASUAL, SPORT, AND WORK

Figure 2A:
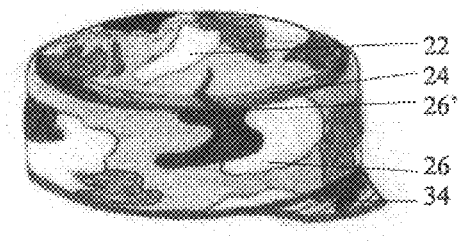
FIG. 2A shows a pictorial, perspective view of my hat with a bill exposed.
Figure 2B:
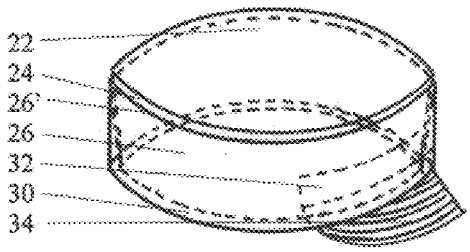
FIG. 2B shows a schematic line drawing of the hat of FIG. 2A.
Figure 2C:
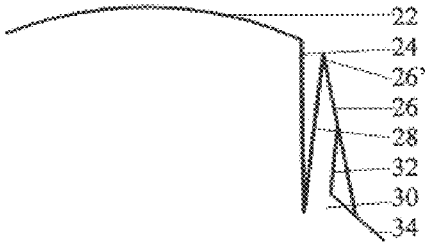
FIG. 2C shows cross-sectional view of the hat of FIG. 2A with the rim surrounding the crown and the bill extending outward.
Figure 2D:
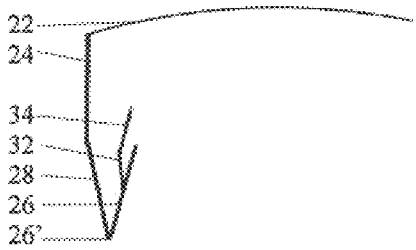
FIG. 2D shows a cross-section view of the rim and bill of the hat of 2A with the rim turned downward and the bill extending upward within the crown.
Figure 2E:
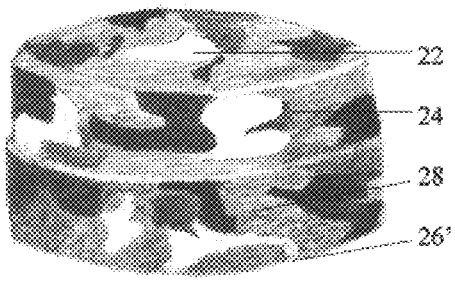
FIG. 2E shows a frontal, perspective view of the hat of FIG. 2A with the rim turned down and the bill extending into the crown as shown in FIG. 2D.

A second embodiment of my convertible hat is shown in FIGS. 2A to 2F, with the exception of FIG. 2E. Specifically, the complete hat is shown in pictorial view in FIG. 2A and in schematic view in FIG. 2B. The details of the side panel and rim are shown in FIG. 2C. The features of the first preferred embodiment are duplicated in this conformation of the Convertible Hat.

This embodiment, however, introduces two new elements to the convertible hat not discussed in the first embodiment. First is an open channel 30, most clearly shown in FIG. 2C. This open channel is formed between layers 28 and 26 and opens downward. At least some portion of this open channel must remain open to accommodate the second element.

Figure 2F:
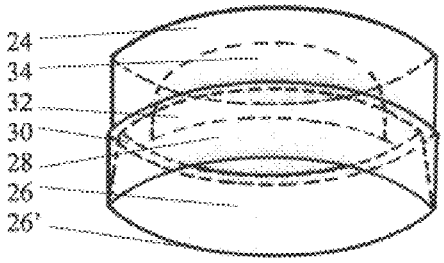
FIG. 2F shows a schematic line drawing of the hat in the conformation of FIG. 2E.

This second element is a bill 32–24 shown in all FIGS. 2A–2D and in FIG. 2F. It is a principal functional element of the hat in this conformation. The bill has both a visible portion 34 and a flange portion 32. The flange portion is not ordinarily seen and is used to attach the bill to the hat. The bill can be made from any of the materials used to fabricate the hat.

The bill of the convertible hat departs from more current designs in the marketplace. It returns to a shape used in hats and caps in earlier years. The bill is modified in at least three ways: it is made softer and less rigid, it is shorter, and it is designed to slope somewhat more and fit closer to the forehead. This arrangement provides glare and weather protection comparable to the more routine forms of current bills. However, it also increases protection for the forehead in cold or windy conditions and is less wind resistant. This also makes those models using a bill crushable, requiring less storage space and less care.

The flexibility of the channel hat is such that a number of options exist in affixing the bill. Using the flange 32, it can be attached to either the inner layer 28 or outer layer 26 of the rim, but always within the open channel 30. Most usually, the attachment is made to the outer layer 26. As a rule, simply sewing the flange into position does this. Exact placement of the attachment depends upon the depth of the open channel 30 and the overall size of the bill. The most typical position is about midway between edge and top. This allows the bill to be inverted or tucked into the open channel 30 and hidden from view when desired.

An alternative to sewing is the use of a hook-and-loop fastener to attach the bill within the open channel 30. Done this way, bill can be removed, inverted and replaced within the open channel, being invisible to the eye. A further extension here is the possibility of using a number of different bills with the same hat.

The manufacturer has many options for producing the bill. It can be made of the same material or different materials as the rest of the hat. It must be reasonably soft but have sufficient body to hold its shape. It must have the resiliency to return to its original shape after being crushed even for extended periods. One manner of achieving this is with a series of concentric stitches following the contour of the basic shape. Most usually, the bill is constructed of multiple layers, sometimes with an internal reinforcing layer.

OPERATION—FIGS. 2A–2E—SECOND PREFERRED EMBODIMENT

In the second embodiment the convertible hat uses the open channel 30 to provide a bill 34 in addition to the option of converting the rim as in the first embodiment. The bill flange portion 32 is attached within the open channel with the exposed portion 34 extending outward from the rim as shown in FIGS. 2A and 2B.

FIGS. 2C and 2D show the manner of converting the hat in this embodiment. The rim 26–28, containing the bill flange 32, is again turned outward and downward. This action brings the outer layer 26 toward the head and extends the rim downward. The bill 34 now is directed upward within the crown and is no longer visible.

FIG. 2E illustrates the appearance of the convertible hat when transformed by inverting the rim. FIG. 2F shows the schematic view of the internal structure of the hat in this conformation. It should be evident that the ability to convert a billed hat to a different look for cold or adverse weather is a real benefit.

Advantages

The advantages of the hat in this embodiment include all of the ones in the presently first preferred embodiment. In addition, a number of additional advantages are evident. Some of these are:

(a) The bill provides added protection from sun, glare, wind, rain, and other forms of precipitation.

(b) The range of "looks" is greatly increased and the hat can be worn in more ways.

(c) Being less formal, it may have more general appeal to a broader public.

(d) People who enjoy baseball caps will find this a less dramatic shift and will get many new advantages with this hat in cold or adverse weather.

(e) It has an outdoors look and can be easily adapted to a military style hat.

DESCRIPTION—FIG. 3A–3E—THIRD PREFERRED EMBODIMENT OPTIONAL BILL

A third preferred embodiment of my hat is shown in FIGS. 3A to 3E. The essential construction of the hat is the same as that shown in FIG. 2A through FIG. 2F. FIGS. 3A and 3B show the same hat in different conformations.

Though the appearance of FIG. 3B and FIG. 1A may look the same, the distinction is in the bill. There is no bill in FIG. 1A, while the bill seen in FIG. 3A has been hidden from sight in FIG. 3B.

The cross sectional view shown in FIG. 3C illustrates how the bill flange 32 remains attached to the rim outer layer 26. As explained earlier, this attachment could be made to the inner layer 28. The normally exposed portion of the bill 34 here extends upward within the open channel 30.

FIG. 3D shows a schematic line drawing of the hat in the conformation of FIG. 3B. Again, the ordinarily visible portion of the bill 34 is shown extending upward inside the rim.

FIG. 3E shows the hat of FIGS. 3A and 3B in a schematic line drawing but with the rim inverted or turned downward. The pictorial representation is the same as that seen in FIGS. 1D and 2E. Again the distinction is with the placement of the bill. Unlike FIG. 2E, the bill here remains within the rim open channel 30, as it does in FIGS. 3C and 3D.

OPERATION—FIG. 3A–3E—THIRD PREFERRED EMBODIMENT OPTIONAL BILL

The flexibility and variability of the convertible hat are shown even more clearly in this third preferred embodiment. FIGS. 3A and 3B show the same hat with two very different looks. The change is accomplished simply and quickly by tucking exposed portion of the bill 34 within the open channel 30 of the rim.

The process of tucking the exposed portion of the bill 34 into the rim will depend upon the manner of the attachment of the flange portion of the bill 32 within the rim. The design and construction of the bill basically provides an opportunity to hinge the bill between the flange 32 and the exposed portion 34. This is generally where the bill is bent to turn upward.

Changing to the adverse weather conformation shown in FIG. 3E is easily accomplished. The bill remains within the rim as in FIGS. 3C and 3D. The whole rim is inverted and the bill stays in place. In this manner the bill does not extend into the crown as it does in the second embodiment.

Advantages

From the description of the hat in this embodiment a number of advantages become evident:

(a) An exposed bill need not be a permanent feature.

(b) Immediate change of style and tone are available.

(c) The same hat adjusts to the changing needs of the wearer.

(d) With bill hidden, the conversion to the adverse weather conformation is quite easy

DESCRIPTION—FIG. 4A and 4B—ALTERNATIVE EMBODIMENT

The embodiment of FIGS. 4A is similar to that of FIG. 3E but has different surfaces and a different conformation. The previously visible portion of crown side panel 24 is now the inner surface. The inner layer 26 of channel rim becomes exposed. The outer surface 28 of rim is turned inward toward head. The fold 26' in the rim now is at the bottom while the open channel 30 is outward and pointing upward. The bill 32–34 is tucked within the open channel 30 of the rim and remains hidden. The actual appearance of the hat in this conformation is much like that of FIGS. 1D or 2E.

OPERATION—ALTERNATIVE EMBODIMENT

The embodiment of FIGS. 4A and 4B provide another approach to the cold or adverse weather mode. In this mode the whole hat is inverted and the crown is pushed upward. The drawings show that it is necessary to tuck the bill into the open channel in this conformation. This is illustrated in FIG. 4B. What were the inner surfaces of crown and channel rim have become the external surfaces. Essentially, this has made the hat reversible. This is a very practical alternative if the user desires to make the hat appear quite differently in varying situations. An example of this would be a camouflage material on one side and reflective orange on the other. The appearance of the inner stitching on the crown is more important in this mode. That is because this stitching is exposed when the hat is worn in this manner. Though practical, this is not a preferred conformation Advantages (a) It is possible to use this approach to offer a hat that can be used inside out.

(b) In this embodiment the opposite rim layer can be placed against the head.

DESCRIPTION—FIGS. 5A through 5D—ADDITIONAL EMBODIMENT

FIGS. 5A through 5D show a modification that will be of interest in some situations. This embodiment provides a bill while the hat is worn in adverse weather conformation. FIG. 5A shows a slot opening 36 in the upper portion of the inner layer 28 of the channel rim. FIG. 5B illustrates the manner of passing a portion of exposed bill 34 through the slot opening. The flange 32 remains attached as is normal, so the bill can be used in the more standard form when desired.

FIG. 5C shows a perspective schematic view of the whole hat in this conformation. Since the rim is turned downward in this conformation, the exposed portion 34 of bill now extends down and outward below the edge of channel rim and becomes visible and useable. There is less need for a large bill in this form, and the exposed bill becomes shorter when used this way. FIG. 5D illustrates a cross section view of this arrangement with the bill passing through the slot opening 36.

OPERATION—ADDITIONAL EMBODIMENT

This embodiment provides for the use of a bill while the hat is worn in adverse weather conformation. FIG. 5B shows the bill passing from within the open channel 30 of the rim through the slot 36 in the inner layer 28 and extending beyond the edge of rim. The wearer now has the added protection of the bill.

FIGS. 5C & 5D show the completed hat with channel rim turned down to the adverse weather conformation. In this manner, the exposed bill 34 extends beyond the rim while the hat is worn lower on the head.

Advantages (a) The slot in the inner layer is invisible when not in use.

(b) This modification does not present the hat from being worn in the normal manner.

(c) The wearer can quickly and easily make the conversion.

(d) Even in extreme weather a bill can be used.

CONCLUSION, RAMIFICATIONS, AND SCOPE

Accordingly, the reader will see that my convertible hat is innovative. It broadly expands the options of use of a hat and addresses many of the limitations of current headwear. It was developed to encourage more people to begin to use hats on a regular basis. This design does not significantly alter many of the standard production processes but provides greater value for the buyer.

It is very adaptable to changing weather conditions and alterations can be made quickly and easily. It provides for an almost unlimited range of color and style combinations, significantly broadening the interest in wearing a hat. It can be made from a very large variety of materials. It can be very appealing for men, women, or children. Since it is compressible, storage difficulties are greatly reduced and the common problems of what to do with a hat in a restaurant or theater disappear. It offers a true winter option for those devoted to wearing baseball style hats. It adapts quite well to sports, work or even military use.

As presented, many ramifications become immediately available. The fundamental channel rim design provides a small style change with an appearance not totally uncommon in the marketplace. However, the use of the rim provides new means to adapt the hat for different purposes and uses. By simply turning the rim downward, it can immediately be transfigured to address changing needs during varying weather conditions. It can be worn in conformations that will appeal to most ages as well as both sexes The dress or millinery versions of the convertible hat can be made extremely stylish. The potential use of a variety of materials and colors offers opportunities to coordinate the hat with any wardrobe. Creative use of colors and materials can enhance many outfits for men or women.

The bill, when offered with the convertible hat, can be used or made to disappear. This provides significant flexibility and new options for work or sports use. The redesigned bill offers several advantages over most of the bills now found in the marketplace.

Because this hat can be folded, compressed, and is crushable, concerns about storage are greatly reduced. This also makes packing, shipping, and handling easier for producers, distributors and retailers.

Realistically, the scope of my convertible hat is almost unlimited. It has practical value and use for all seasons. Its purpose is always the same, to cover and protect the head in varying situations. However, the range of conditions where my convertible hat can serve is enormous. From sun to wind and cold it offers head coverage that is flexible, fun and practical.

For dress and higher style, it introduces a revised look in the marketplace. Because it can be made from a huge variety of materials, it offers options rarely possible before. Fur or faux fur are very practical for use with my convertible and these can readily be combined with a range of materials. This provides for millinery style options that are very progressive and can readily be built upon by hat stylists.

When used for casual wear my convertible hat provides a medium for expressing a person's personality. With a range from basically practical to outlandishly flamboyant the hat wearer can make a statement about who he or she is and how life is viewed. It brings with it the means to have fun with a hat and to match a mood with special headwear.

For the outdoors person my hat opens the door to many uses. Since it is adaptable to varying weather conditions, it offers a great deal more than any existing hat now available. Its very nature provides singular opportunities to personalize it for the sports fan. Individual team hats for fans of most outdoor sports are well within the scope of my convertible hat. This would also be true for fans of such sports as NASCAR and their favorite drivers.

As a work hat or part of a uniform my convertible hat offers renewed flexibility and realistic options. Though possible as an all-season hat, it would more likely be provided in the form of a summer version and a heavier, winter weight form.

The military applications of my convertible hat are quite evident. It is readily produced in camouflage form and can easily be made as a dress, field or fatigue version. Even services like the navy should find very practical reasons for adopting the use of my convertible hat for sailors. Its capacity for wind resistance and immediate adjustment to altering weather conditions would be worthwhile.

What is claimed is:

1. A convertible hat, comprising:

a crown for covering at least a part of a person's head, said crown having a flat or meniscus shaped top and a lower edge which surrounds the side of said person's head when said crown is placed upon said person's head, an annular wall having a predetermined height and shaped to fit around said side of said crown, said annular wall comprising a plurality of layers so as to form a pocket or channel between said plurality of layers, one of said layers of said annular wall being attached to said lower edge of said crown, whereby said annular wall can be folded up to provide a rim around said crown or folded down to effectively extend said crown for colder weather.

2. The convertible hat of claim 1, further including a bill attached to one of said plurality of layers of said annular wall, said bill being flexibly attached to said wall so that it can be tucked between said layers of said wall or can extend out from said annular wall.

3. The convertible hat of claim 2 wherein said bill is attached to a bottom of said annular wall and said layers of said wall are open at a bottom of said wall to form a pocket, said pocket being accessible at said bottom of said wall, so that said bill extends out from a bottom of said wall, or can be tucked into said pocket from said bottom of said wall.

4. The convertible hat of claim 2 wherein said bill is attached to a part of said wall spaced from a bottom of said wall, an outer layer of said wall having a slot therein at a location spaced from said bottom of said wall, so that said bill can be extended out through said slot in said wall, or can be tucked into said layers of said wall.

5. The convertible hat of claim 2 wherein said bill comprises a visible portion and a flange portion, said flange portion being attached to said annular wall and said visible portion extending out from said annular wall when said bill is not tucked into said pocket.

6. The convertible hat of claim 1 wherein said top is flat.

7. The convertible hat of claim 1 wherein said top has a meniscus shape.

8. The convertible hat of claim 1 wherein said hat is made from cloth or other forms of flexible material.

9. A convertible hat, comprising:

an annular wall having a predetermined height and shaped to fit around the side of a crown, said annular wall comprising a plurality of layers which are joined or continuous at the top of said annular wall and are open at the bottom of said wall so as to form a pocket or channel between said plurality of layers, said pocket being accessible at said bottom of said wall, and a bill attached to and extending out from a bottom of said wall, said bill being flexibly attached to said bottom of said wall so that it can be tucked into said pocket or can extend out from said bottom of said wall.

10. The convertible hat of claim 9, further including a top attached to a side to form a crown for said hat.

11. The convertible hat of claim 10 wherein said crown top is flat.

12. The convertible hat of claim 10 wherein said top has a meniscus shape.

13. The convertible hat of claim 9 wherein said hat is made from cloth or other forms of flexible material.

14. The convertible hat of claim 9 wherein said bill comprises a visible portion and a flange portion, said flange portion being attached to said wall and said visible portion extending out from said wall when said bill is not tucked into said pocket.

* * * * *